United States Patent [19]

Groundwater

[11] 4,244,460

[45] Jan. 13, 1981

[54] PROCESS AND EQUIPMENT TO FORM MODULES OF BISCUITS OR OTHER LIKE PRODUCTS

[76] Inventor: Fergus M. Groundwater, 194 Betournay St., St-Lambert, Quebec, Canada

[21] Appl. No.: 938,536

[22] Filed: Aug. 31, 1978

[51] Int. Cl.[3] ..... B65G 47/26

[52] U.S. Cl. ..... 198/429; 198/449; 414/330

[58] Field of Search ..... 198/425, 429, 448–452, 198/365, 601, 653; 414/330

[56] References Cited

U.S. PATENT DOCUMENTS

| | | | |
|---|---|---|---|
| 2,315,670 | 4/1943 | Tascher et al. | 198/448 |
| 2,954,881 | 10/1960 | Hopton et al. | 414/330 |
| 3,071,236 | 1/1963 | Hahn et al. | 198/425 |
| 3,402,803 | 9/1968 | Griner | 198/448 |
| 3,407,916 | 10/1968 | Engeler | 198/429 |
| 3,479,024 | 11/1969 | Miller et al. | 198/448 |
| 3,779,364 | 12/1973 | Kammann | 198/653 |
| 3,811,549 | 5/1974 | Preisig | 198/425 |
| 4,044,897 | 8/1977 | Maxted | 198/448 |

FOREIGN PATENT DOCUMENTS

| | | | |
|---|---|---|---|
| 2335630 | 11/1974 | Fed. Rep. of Germany | 198/449 |

*Primary Examiner*—Joseph E. Valenza

[57] ABSTRACT

A process and apparatus is described for the formation of a single row of regularly spaced discrete modules of thin products such as biscuits stacked face to face, from several rows of continuously moving products. As each row of products enters the apparatus, a module of products having a predetermined length is separated from the leading end of the row and is transferred into a pair of carrier fingers which supports the module of products. A module is formed at the end of each row in a timed sequence and the modules of products are then moved through a set of delivery channels by the carrier fingers into a common outlet channel.

16 Claims, 12 Drawing Figures

PROCESS AND EQUIPMENT TO FORM MODULES OF BISCUITS OR OTHER LIKE PRODUCTS

This invention relates to a process and an apparatus for automatically and continuously forming a single row of regularly spaced-discrete modules of products from several rows of continuously moving products. The invention also relates to an improved module forming mechanism.

BACKGROUND OF THE INVENTION

The production of biscuits and other similar products is often performed in a continuous manner on a moving production line. These products are usually processed in sheets or rows with adjacent biscuits contiguous or spaced apart. The product is normally packaged in individual portions by weight or other measure.

When produced in sheet form, it is common practice to break the sheet of product into individual units and to align the individual biscuits into rows. If the product is produced as individual biscuits, it is normally produced in rows, which may also require alignment.

It is common practice to further process the product in such a way as to stand the biscuits vertically on their edges, through the use of devices known commonly as stackers. Thus, at some stage in the production process, a multiplicity of continuously advancing rows of biscuits or thin products, standing side by side on edge, or stacked face to face are presented to be measured out into modules generally according to weight or length and further processed and packaged.

Traditionally the measuring out of modules and placement of the modules in equipment for further processing and/or packaging has been accomplished manually. Owing to ever increasing rates of production and the increased labor cost, the performance of these tasks manually is becoming too expensive and non competitive.

STATEMENT OF THE INVENTION

It is therefore the object of the present invention to describe a process and an apparatus for automatically and continuously forming a single row of regularly spaced discrete modules of products from several rows of continuously moving products, the modules being of uniform length and ready for packaging or other types of additional processing.

The process, in accordance with the invention, comprises the steps of separating a discrete length of products from the leading end of each row of products to form modules of products, transferring such modules into separate carriers which support each module, and merging such modules continuously and uniformly to form a single row of modules uniformly spaced for delivery to other equipment.

The modules are preferably formed at the leading end of each row of products in a sequential manner.

The step of transferring the modules into separate carriers includes the step of raising the modules vertically above the row of products prior to feeding the modules into rows of delivery channels which merge into a single main channel.

The apparatus, in accordance with the invention, comprises a module former for dividing a discrete length of products from the leading end of each row to form modules of products, means for transferring such modules into separate carriers which support such modules, and means for moving such carriers so as to merge the modules into a single row of modules uniformly spaced for delivery to other equipment.

A preferred but not restrictive embodiment of the invention comprises a lower feed belt supporting each row of products and an upper feed belt extending over a predetermined length of the end of each row of products to assure positive delivery of the products into the module former. The feed belts on each row are preferably driven by separate drives so that the formation of modules can be made in a sequential manner.

A rigid support extends from the termination of the lower feed belt into the module former and the products are supported by side guides on both sides the entire length of the module.

A cylinder device having a retractable piston is mounted on the apparatus at the opposite end of the module former. Such piston extends through the module former and is arranged to retract synchronously with the advancing forward edge of the row of products. The piston device prevents products standing on edge from falling forward and maintains them in an orderly fashion until the leading end of the row of products reach a stop, at which time, which, upon contact with the leading end declutching of the drive for the row of products takes place and a separator is energized to divide a module of the desired length from the leading end of the product row.

The means for transferring the modules onto the carrier comprises lift slats built into the sides of the module former and engaging the module of products on each of its lower edges, and a prime mover for lifting the module former above the row of products.

The carrier comprises a pair of moving carrier blocks including fingers adapted to engage the front and rear ends, respectively, of the modules when the modules are raised by the module former. The carrier blocks are slidably mounted upon shafts in such a way as to move transversely to the direction of travel of the carrier blocks and the means for moving such carriers is a pair of carrier block chains moving at constant speed, one attached to the front carrier block shaft and the other attached to the rear carrier block shaft.

While the module former is in the raised position, the modules of products resting on the lift slats are pushed by the carrier block fingers out of the module former into delivery channels which merge into a single main channel. A cam track is positioned above the delivery channels to cause the carrier blocks to follow the delivery channels into the single main channel. Each carrier block is provided with a cam follower engaging the cam track to cause the carrier blocks to be translated transversely as they move throughout the delivery channels.

The carrier blocks are also rotatably mounted on the shafts and biased in the vertical position by a torsion spring. A second cam is mounted above the module former and a second cam follower mounted on the front carrier block to engage such second cam to cause the front carrier fingers to rotate to a horizontal position as they pass over the module former to prevent the front carrier fingers from impinging on the module of products.

A third cam is located adjacent the end of the delivery channels and a third cam follower mounted on the rear carrier blocks for engaging such cam and cause the rear carrier block fingers to remain in a nearly vertical attitude while the module is being transferred to other equipment.

The limit of travel stop is adjustable so that the length of all modules can be adjusted. The rear carrier block chain is driven by a motor and the front carrier block chain is adjustably coupled to the rear carrier block chain so as to adjust the space between the front and rear fingers to cater for different lengths of modules.

BRIEF DESCRIPTION OF THE DRAWINGS

The invention will now be disclosed, by way of example, with reference to the accompanying drawings in which.

PREFERRED EMBODIMENT OF THE INVENTION

Figure 1:
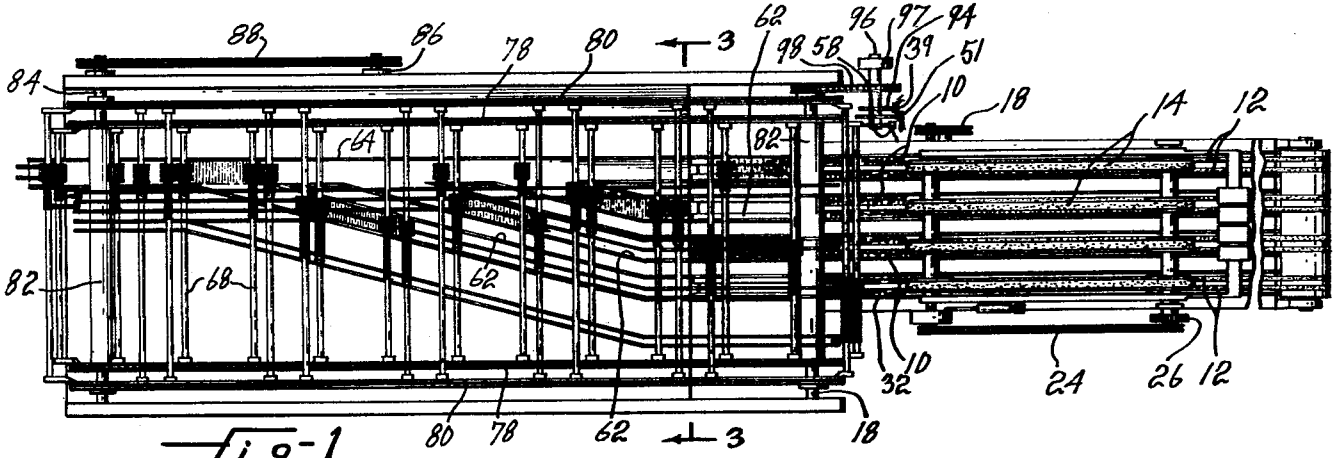
FIG. 1 is a plan view of the apparatus in accordance with a preferred embodiment of the invention.
Figure 2:
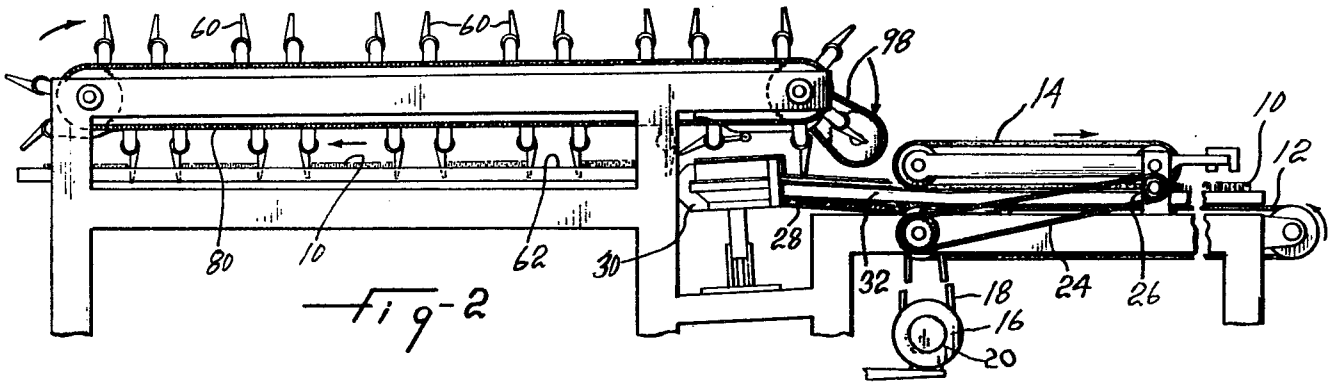
FIG. 2 is a side elevation of the apparatus of FIG. 1.

In the drawings, the case of four rows of biscuits being processed is considered for descriptive purposes, although the principle of the invention is applicable for any practical multiplicity of rows and for thin products other than biscuits.

The rows of biscuits 10, standing on edge, are shown entering the apparatus at the start of the process. The biscuits are carried by moving belts 12 under the row. In addition, a top belt 14 is provided to assure positive delivery of the biscuits into the apparatus. The lower belt is driven by motor 16 through chain 18 and an electromagnetic clutch 20 controlled by a cam operated micro-switch 39. The upper belt is driven by the lower belt through chain 24 and gear 26. The motion of the upper and lower belts is normally synchronized, although for some products a slight desynchronization is beneficial. In addition, the set of belts on each row is placed in motion and stopped independently from the other rows. This is necessary so that the formation of modules can be made in a sequential manner. Motor 16 can be common to all the rows with a clutch 20 for each row and each clutch 20 controlled by its own micro-switch 39. In addition, the speeds of the belts in each row are independently variable to cater for product and other variations.

The rows of biscuits are supported from underneath by the infeed belts and by a rigid central support 28, narrower than the width of the biscuits and which extends from the termination of the infeed belts through a module former 30 which is an open-ended elongated member of U-shaped cross-section defining spaced side walls 31. In addition, the biscuits are supported by side guides 32 on both sides for the entire length of the moving belt 12 and beyond the latter up to the upstream end of module former 30.

Figure 8:
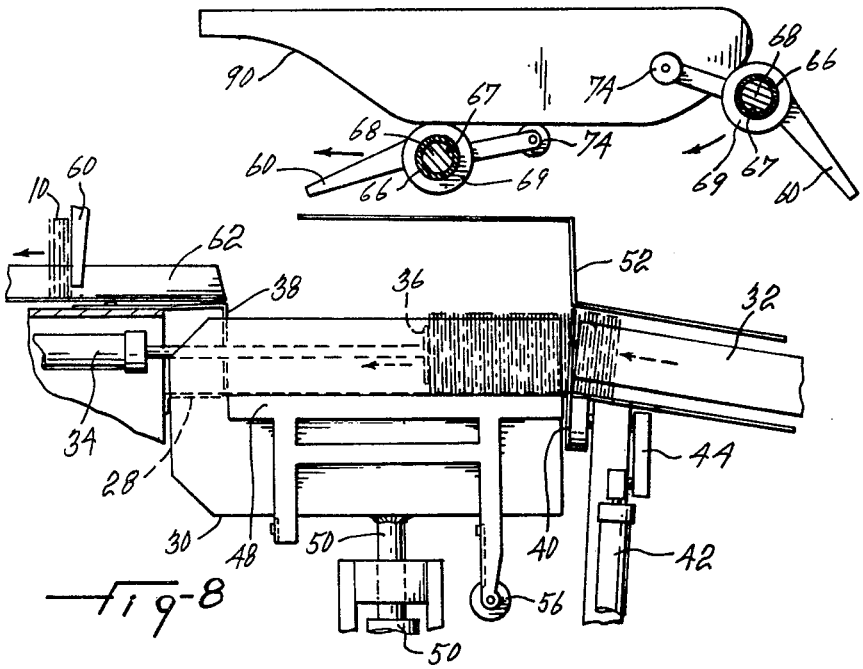
FIG. 8 illustrates the module former in the lower position.
Figure 9:
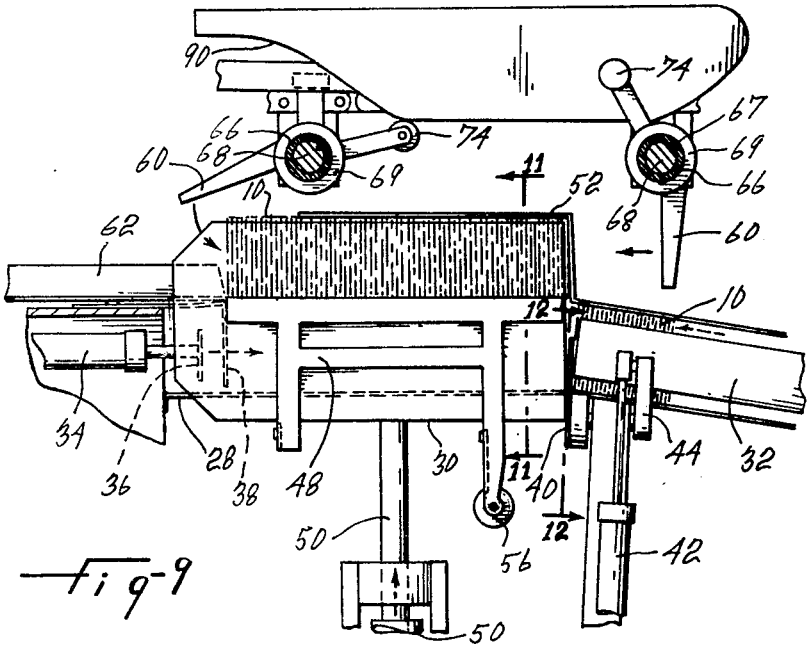
FIG. 9 illustrates the module former in the raised position.

The biscuits then are propelled forward into the module former 30 by the combined action of the upper and lower feed belts for a sufficient duration that the module former is properly filled with products. Referring more particularly to FIGS. 8 and 9, a cylinder 34 having a piston 36, which supports the leading edge of the row of product, retracts synchronously with the advancing forward edge of the row of product. The piston device presents the product from falling forward and maintains it in an orderly fashion until the product reaches a limit of travel stop 38. At this point, the upper and lower belts are caused to cease moving and propelling the product forward by operation of the clutch 20 by a micro-switch 39. As well, the immobile belts then act as a barrier to the balance of the row of biscuits which continue to advance along the production line upstream of the feed belts, thus preventing an over pressure on the biscuit in the module former. The belts motion may be arrested by sensing that the product has reached the stop or, alternately, the motion may be controlled by engaging the belt drive for a planned period of time.

At the conclusion of the feeding motion, the feed belts could be reversed for a short period of time or length of travel, in order to relieve any undesirable pressure existing within the row of biscuits.

Figure 12:
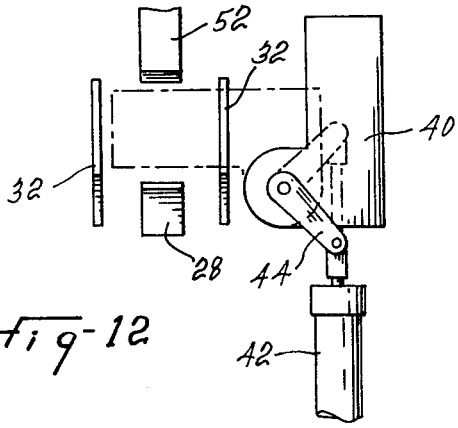
FIG. 12 illustrates a view taken along lines 12—12 of FIG. 9.

At this juncture, a device, termed a separator, is caused to operate, which divides a module of the desired length from the leading end of the product row. As shown more clearly in FIG. 12, the separator consists of a thin sheet of flexible material 40, which is automatically inserted between individual biscuits at an appropriate location in the row namely adjacent the upstream end of U-shaped member 30. The separator 40 is pivoted at 40*a* at the side of U-shaped member 30 by a cylinder 42 through linkage 44 and under the control of micro-switch 30. The operation of the separator is synchronized with the operation of the clutch 20 and operated by the same micro-switch. Insertion of the separator 40 between individual biscuits is facilitated because it is effected from above in the area of the angular junction of the inclined upstream portion 28*a* and the substantially horizontal downstream portion 28*b* of central support 28 (see FIGS. 8 and 12) which causes the biscuits to fan out in this area. Because separator 40 is flexible and pivots so as to engage between corners of adjacent biscuits, it easily finds its way between the biscuits without breaking the same. At this juncture, a module of biscuits has been formed which is supported from underneath by the central support 28, on both sides by side walls 31 of U-shaped member 30, at the front by the stop 38 and at the rear by the separator 40.

Lift slats 48 are built into the sides of the module former 30. These slats are positioned on either side of the central support 28 and slightly below it. When U-shaped member 30 is in its lower position, as illustrated in FIG. 8, the function of the lift slats is to engage the module of product on each of its lower edges for lifting the module upwards when the module former is activated.

Figure 11:
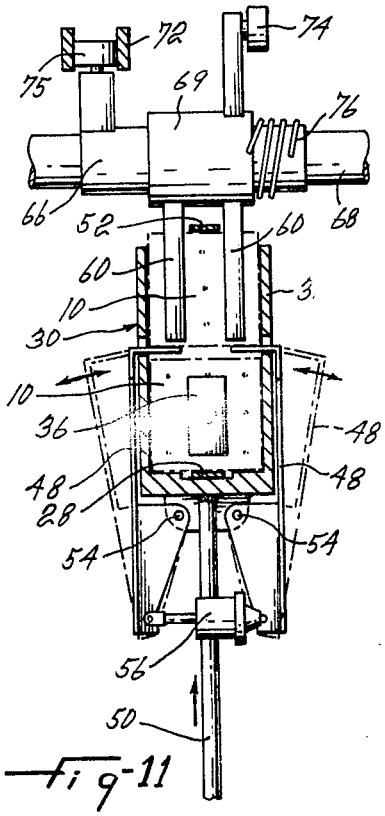
FIG. 11 is a view taken along lines 11—11 of FIG. 9.

The module of product is removed from the row by the module former 30, which is driven upwards by a primemover 50, such as a cam or air cylinder, under the control of a micro-switch 51 (see FIG. 1), a sufficient distance to lift the module clear of the stop 38 and slightly above the main deck of the apparatus. As the module is being raised, biscuits at the rear of the module are prevented from falling backwards by a central top guide 52 which is narrower than the width of the biscuits. This guide also prevents the biscuits from continuing to rise when the module former reaches the upper limit of its travel. The lift slats may be retractable sideways, as illustrated in FIG. 11, when the cycle speed requires that the module former be filled while it is still in the upper position. In such a case, the lift slats must of course be retracted to clear the upper edge of the biscuits already loaded in the module former when the module former is lowered. The slats are pivoted at point 54 by solenoid 56. The energization of solenoid 56 is controlled by micro-switch 58 (see FIG. 1). Follower 36 can move on either side of stop 38. The design of stop 38 can be any design which allows follower 36 to move on either side of stop 38.

As the module of product is raised, it is inserted between a pair of moving carrier fingers 60. The purpose of these fingers is to move the module downstream and merge modules from individual delivery channels 62 into a single common main channel 64.

In order to perform this portion of the process, the carrier fingers and their associated mechanisms incorporate several necessary features. The carrier fingers can be classified as rear and front fingers. Both are similar in construction, consisting of two fingerlike protrusions which protrude from carrier blocks 66. The distance between the protrusions or fingers is arranged in order to effect clearance between the carrier fingers and top guide 52 and also the fingers of the downstream equipment when transferring of the module into such equipment. In addition, the provision of a double finger arrangement enhances the maintenance of module integrity as the process proceeds.

Figure 5:
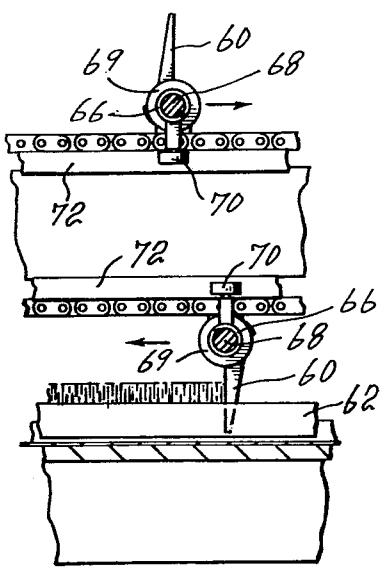
FIG. 5 is a view taken along lines 5—5 of FIG. 3.
Figure 3:
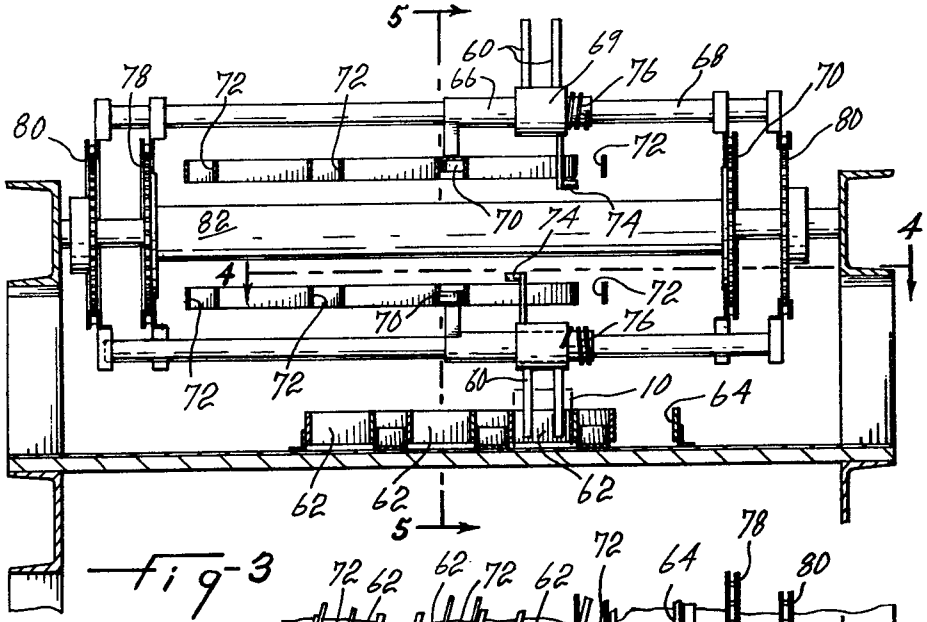
FIG. 3 is a view taken along lines 3—3 of FIG. 1.
Figure 4:
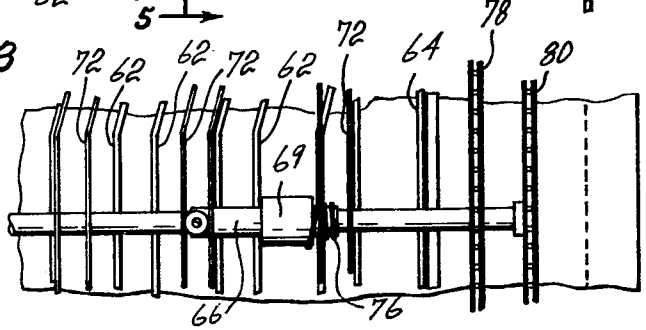
FIG. 4 is a view taken along lines 4—4 of FIG. 3.

Referring more particularly to FIGS. 3–5, the carrier blocks 66 are mounted upon shafts 68 in such a way as to allow the blocks to be moved transversely to the direction of travel of the modules. Blocks 66 are retained against rotation by key 67 sliding in a keyway of shaft 68 (see FIG. 8). Cam followers 70 are mounted on the carrier blocks and engage in cam tracks 72. The purpose of this arrangement is to cause the carrier block and hence the carrier fingers to be translated transversely, as the fingers propel the module through the delivery channel 62. The cam tracks are shaped in such a way as to cause the fingers to follow the centre line of the delivery channels as they move along.

Moreover, the carrier blocks are arranged in such a way as to allow rotary motion of the fingers 60. Referring to FIGS. 8 and 9, the fingers 60 and a second cam follower 74 are secured to a sleeve 69 rotatable on block 66. A mechanical stop (not shown) is also incorporated on the carrier block, which prevents the sleeve 69 and carrier fingers from rotating past a limit vertical position perpendicular to the associated carrier shaft chains 78 and 80. A torsion spring 76 maintains the sleeve 69 and carrier fingers 60 in the vertical position against the stop during most portions of the process.

The springs and stops on the respective rear and front fingers are arranged in such a way as to allow counter clockwise rotation from the limit position against the spring torque by rear fingers and clockwise rotation from the limit position against the spring torque by front fingers.

Figure 6:
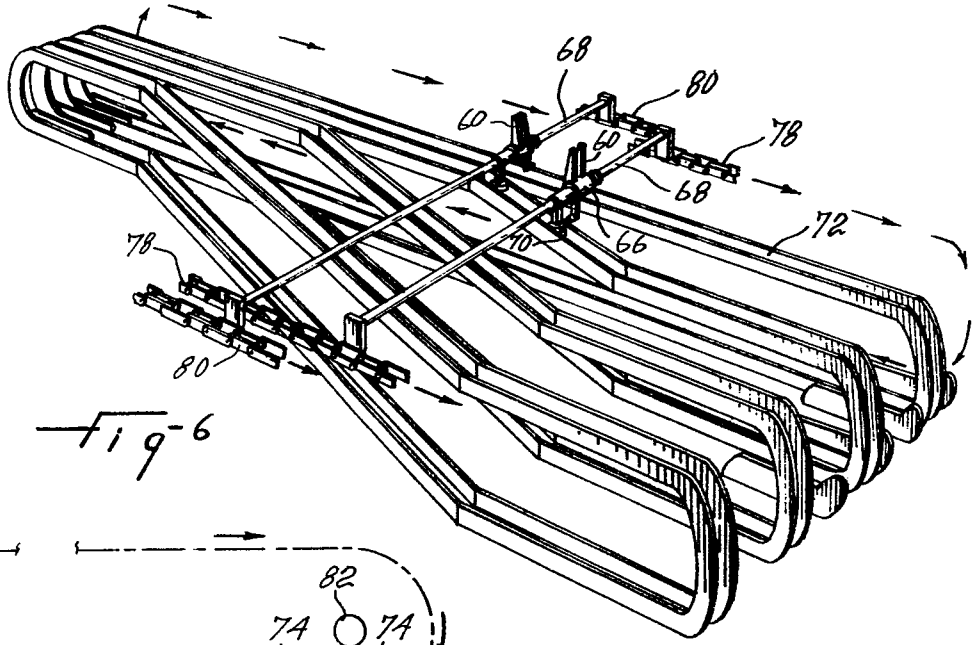
FIG. 6 illustrates more clearly the closed loop cam tracks.

The carrier blocks are thus mounted on shafts, on which they are free to slide transversely as driven by the cam followers as they follow the appropriate cam track. All shafts 68, which carry front fingers, are attached to a common pair of carrier shaft chains 78 at their extremities, which are depicted in FIGS. 3 and 6 as the interior chains. Similarly, all shafts 68, which carry rear fingers, are attached to a common pair of carrier chains 80 depicted as exterior chains.

The main drive shaft 82 for the interior chains 78 is mounted coaxially with the main drive shaft 84 for the exterior chains 80 (see FIGS. 1 and 3). At the idler end of the chains, a similar arrangement is made. Power to drive the shafts at a substantially constant speed is transmitted from a prime mover 86 to the rear finger drive shaft 84 and chains through chain 88.

From shaft 84, power is further transmitted to the front finger drive shaft 82 and chains through a variator (not shown). The variator is a mechanical device which connects one pair of adjacent sprockets for movement of the interior and exterior chains while permitting for manual angular adjustment of one sprocket relative to the other. This arrangement allows for adjustment of the space between front and rear fingers to cater for different lengths of modules under different production conditions or different products processed. The use of a variator ensures the ability to adjust module length.

The motion of the module former is synchronized with the motion of the carrier fingers in such a way as to assure that the module former is rising when a pair of fingers arrive directly above the module former. A cam 90, (see FIGS. 8 and 9) which engages the cam follower 74 on the front carrier fingers, causes the front fingers to rotate to a horizontal position as they pass over the module forming area. This prevents the front fingers from impinging on the module of product as it rises. As the front fingers reach the vicinity of the front of the module, they are returned to the vertical position by the action of the torsion spring and the shape of the cam. This motion coincides with the module of product reaching its maximum rise position and prevents the first few biscuits of the module from falling forward to a horizontal orientation and destroying the integrity of the module. The module former then remains in the raised position, while the rear fingers propel the module out of the module former into the delivery channel 62.

While the module former is in the uppermost position and the carrier fingers are removing the module, the separator 40 remains in position, preventing product at the front end of the row from falling forward prior to advancing into the module former to form the next module.

When the module has been removed from the module former, the module former descends to the lower position under the control of the same micro-switch which caused it to move upwards. Concurrently, the piston device 36 extends to support the front biscuits in the leading edge of the row of product about to form the new module.

When the piston device 36 reaches maximum extension, the separator device 40 rises and permits entry of the product into the module former. The belts then recommence driving the row of biscuits. The piston device 36 retracts until the leading biscuit reaches the limit of travel stop 38. At this point the module former is full and the formation cycle is ready to recommence.

The module, which has been inserted between the carrier fingers, is then propelled along the delivery channels 62 by the carrier fingers. The delivery channels 62 are shaped in such a way as to merge with the outermost delivery channel 64 at various intervals.

The operation of a multiplicity of module formers is controlled in such a way that they form and deliver modules in a sequential fashion row by row across the apparatus. Thus, if the outermost row of module has been formed and is progressing through its delivery channel, then in the next adjacent row a module is formed and delivered to the appropriate delivery channel.

The second module is propelled along the second delivery channel, which merges with the outermost delivery channel and the module assumes a position immediately behind the first module in the outermost delivery channel. The process repeats row by row until each module former has sequentially delivered a module whereupon the process recommences at the outermost row.

The result of the process is that each delivery channel receives a module in sequence. The modules are propelled down the delivery channels in sequence and merge into the common outlet channel in sequence and are spaced uniformly in the latter.

At the end of the delivery track, the module of product can be transferred directly into other equipment automatically. It is common practice to overwrap modules of product with overwrapping materials, such as paper or plastic film. The equipment to perform such operations generally has sets of single carrier fingers protruding vertically upwards through an infeed track.

Figure 10:
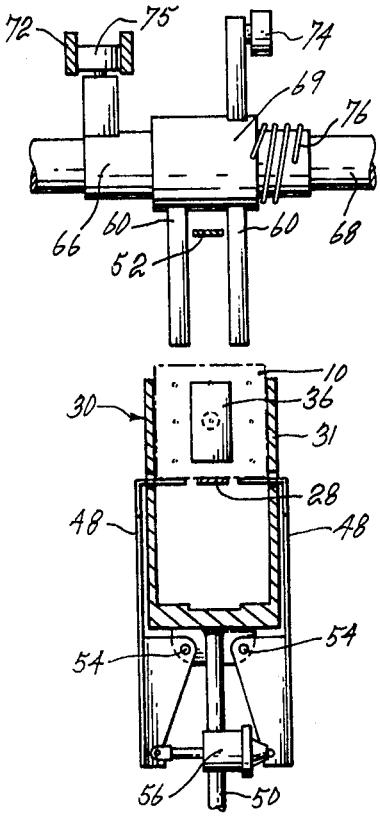
FIG. 10 is a section view taken along lines 10—10 of FIG. 8.

The double finger feature of the module carrier (see FIG. 10) allows for direct transfer of the module into the downstream single finger carrier equipment in a straight line. In this instance, the clearance between the double finger allows the single finger to be synchronized with the double finger for purposes of making the transfer.

Figure 7:
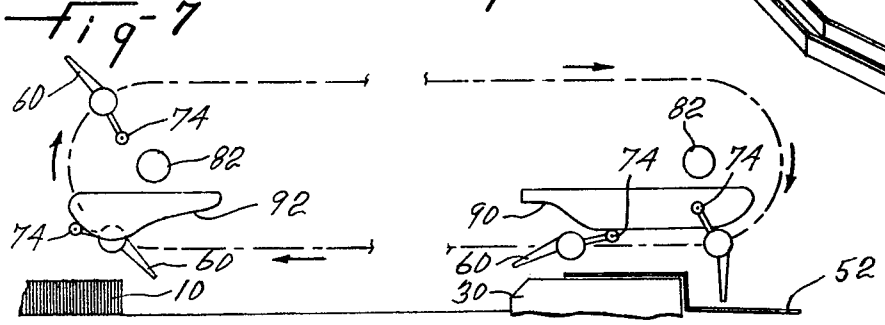
FIG. 7 illustrates the function of the cams engaging the carrier blocks at each end of the carrier block chains.

Another feature which facilitates the transfer of the module is a rear finger transfer cam 92, shown in FIG. 7, which controls the motion of the rear fingers 60. As the transfer is made, the cam follower 74 on the carrier block engages the rear finger transfer cam 92, which causes the fingers to remain in a vertical attitude while the transfer is being accomplished, rather than describing an arc as it moves around the rear drive sprocket. After the module has been transferred, the torsion spring returns the rear fingers to a normal orientation.

As shown in FIG. 6, the cam tracks 72 are essentially a closed loop and the cam folowers 70 remain constantly engaged so that after delivery of the modules to the downstream equipment as the carrier fingers move back to the module former area, the cam followers cause the fingers to be returned to the vicinity above their respective module formers. This process can be likened to a reversal of the merging function performed when the carrier fingers are moving adjacent to the apparatus deck.

The length of module formed is controlled by the adjustable stop 38 located in the module former. Each row has such a stop and they are all mounted on a common movable frame, so that adjustments to the length of all modules formed can be made simultaneously to all rows in equal amount, while the equipment is operating or stopped. In addition, a further adjustment is provided so that each row may be independently adjusted in order to cater for production anomalies from row to row.

The guides 32 which confine rows or act as delivery channels are adjustable to cater for different sizes of products. Interchangeable guides with special shapes permit the processing of other than regular geometric shapes.

By judicious choice of the total number of sets of carrier fingers in the apparatus and through mechanical adjustments, it is possible to perform the process using a variable number of rows in a given apparatus. For example, if for a six row apparatus it is desirable to operate only four rows, and the apparatus has 24 sets of carrier fingers, then through minor mechanical adjustment and retiming of the module formers, the 24 sets of carrier fingers can be re-arranged to operate in the fashion of six sets operating only in four rows, as opposed to the normal operation of four sets of carrier fingers operating in six rows.

Referring to FIG. 1, a plurality of cams 94 are mounted on a shaft 96 mounted in a bearing 97 and coupled to main shaft 82 through chain 98. The cams operate micro-switch 39 controlling infeed belts 12 and 14, and separator 40, the micro-switch 51 controlling module former 30, and micro-switch 58 controlling the lift slats (if required). The above cams insure synchronized operation of all the various components of the apparatus. The sets of micro-switches and cams are repeated for each row. It follows that shaft 82 controls the operation of the module forming mechanism. The carrier fingers move at constant speed and their staggered position across the delivery channels determines the sequential operation of the several module-forming mechanisms and the sequential delivery of the modules to downstream further processing equipment. Since module forming takes place at each infeed row, it can be carried out at a lesser speed than if done after merging of the rows.

Although the invention has been disclosed with reference to a preferred embodiment, it is to be understood that various alternatives of such embodiment are also emphasized and that the invention is to be limited by the scope of the claims only.

What I claim is:

1. An apparatus for automatically and continuously forming a single row of regularly spaced dicrete modules of thin products, stacked face to face such as biscuits, from several uninterrupted feeding rows of products, also stacked face to face, comprising:

(a) a module former for separating a discrete module of products, said module having a predetermined length, from the leading end of each feeding row of products;

(b) means for transferring said modules into separate carriers which support said modules, said means comprising lift slats built into the sides of the module former and engaging the module of products on each of its lower edges, and a prime mover for lifting the module former above the row of products, each of said carriers comprising a pair of moving carrier blocks including fingers adapted to engage the front and rear ends, respectively, of the modules when the modules are raised by the module former; and (c) means for moving said carriers so as to merge the modules into a single row of modules uniformly spaced for delivery to other equipment.

2. An apparatus as defined in claim 1, wherein said carrier blocks are slidably mounted upon shafts in such a way as to move transversely to the direction of travel of the carrier blocks, and wherein said means for moving said carriers is a pair of carrier block chains, one attached to the front carrier block shafts and the other attached to the rear carrier block shafts.

3. An apparatus as defined in claim 2, further comprising several delivery channels extending from the module former while in the raised position for merging said modules into a single channel and a cam track shaped in such a way as to cause the carrier blocks to follow the center of the delivery channels, and wherein each carrier block is provided with a cam follower engaging said cam track to cause the carrier blocks to be translated transversely as they move through the delivery channels.

4. An apparatus as defined in claim 2, wherein the fingers are rotatably mounted on the carrier blocks, and further comprising means to prevent rotation of the carrier blocks relative to the shafts and torsion springs biasing the fingers relative to the carrier blocks in the vertical position, a second cam mounted above the module former and a second cam follower rigid with said front carrier fingers and mounted on the associated front carrier blocks and engaging said cam to cause the front carrier fingers to rotate to a horizontal position as they pass over the module former to prevent the front carrier fingers from impinging on the module of products.

5. An apparatus as defined in claim 4, further comprising a third cam adjacent the end of delivery channels and a third cam follower rigid with said rear carrier fingers and mounted on the associated rear carrier blocks for engaging said cam and cause the rear carrier fingers to remain in a nearly vertical attitude while the module is being transferred to other equipment.

6. An apparatus as defined in claim 2, further comprising a motor driving the rear carrier block chain, and wherein the front carrier block chain is adjustably coupled to the rear carrier block chain so as to adjust the space between the front and rear fingers to cater with different lengths of modules.

7. An apparatus for automatically and continuously forming a single row of spaced discrete modules of thin products stacked face to face, such as biscuits, from several uninterrupted feeding rows of such products, also stacked face to face, comprising:

(a) a feeding conveyor means for each feeding row;

(b) as many delivery channels as there are feeding conveyor means, each delivery channel having an inlet end longitudinally spaced from and misaligned with the discharge end of the associated feeding conveyor means;

(c) a module former located between the discharge end of each feeding conveyor means and the inlet end of each delivery channel, means to shift said module former between a first position in alignment with the discharge end of the associated feeding conveyor means, to allow filling of said module former by said feeding conveyor means with products occupying a predetermined length and form a module therein, and a second position in which said module former and module therein are aligned with the inlet end of the associated delivery channel;

(d) a separator movable between two adjacent products of said feeding row at the upstream end of said module former to separate said module from the remaining products of said feeding row and retain said last-named products while said module former is shifted to its second position;

(e) means to stop said feeding conveyor means operable when said module former has been filled with products;

(f) a common outlet channel, said delivery channels merging at their outlet ends with said common outlet channel;

(g) at least one module carrier for each module former and associated delivery channel, each carrier including longitudinally spaced front and back fingers between which a module is inserted, said carrier movable in a path along said module former, said associated delivery channel and said common outlet channel to transfer said module from said module former while the latter is in its second position, onto said delivery channel and along said delivery channel and said common outlet channel;

(h) means for moving said carriers at a constant speed, said carriers being uniformly staggered across said delivery channels and uniformly-spaced longitudinally of said common outlet channel; and (i) means initiating operation of said shifting means upon each carrier coming in register with an associated module former to receive a module between said fingers.

8. An apparatus as defined in claim 7, further comprising a follower device and a limit of travel stop mounted at the downstream end of the module former, said follower device having a piston extendable through said limit of travel stop and which supports the leading product of the row of products and retracts synchronously with the advancing leading product of the feeding row of products to a position beyond said limit of travel stop, which latter then contacts the leading product of the feeding row of products.

9. An apparatus as defined in claim 8, wherein said separator consists of a thin, flexible blade pivoted at one side of said module former and at the upstream end of the latter and power-pivotable across the row of products to extend between two adjacent products by first engaging between the top corners of said adjacent products.

10. An apparatus as defined in claim 9, further including a stationary supporting strip of a width narrower than said products and supporting said products from underneath, said supporting strip extending from the discharge end of each feeding conveyor means and through the module former beyond the downstream end of the module former, said supporting strip making a downward bend in register with said separator to fan out the products and facilitate insertion of said blade between adjacent products.

11. An apparatus as defined in claim 10, wherein the inlet end of each delivery channel is at a higher level than the discharge end of the associated feeding conveyor means, and said means to shift said module former consists of means to rise said module former, said module former including lift slats engaging the lower corners of the products on each side of the supporting strip.

12. An apparatus as defined in claim 10, further including a stationarily-mounted back guide strip narrower than said products and extending upwardly from, and in substantial, vertical alignment with said separator blade when the latter is in active separating position, said back guide strip extending centrally of the back of the trailing product of the module in the raised position of the module, said back finger of said carrier being forked to move on each side of said back guide strip as said carrier receives a module between said back and front fingers.

13. A mechanism for forming modules of thin products stacked face to face, such as biscuits, and located at the outlet end of a feeding conveyor on which an uninterrupted row of such products, also stacked face to face, are fed to said mechanism, the latter including an elongated module former including two spaced guiding side walls aligned with said feeding conveyor, a stationary support strip narrower than said products aligned with the center of the outlet end of said feeding conveyor and extending centrally between said side walls to support products pushed between said side walls by products moved by said feeding conveyor, by engaging said products along the center portion of their lower edge, and end of travel stop located between the downstream portion of said side walls for engaging the leading product of the row of products supported on said support strip, a separator consisting of a thin, flexible blade pivoted at one side of said module former at the upstream end of the latter and power-pivotable across the row of products to extend between two adjacent products and separate a module of products in said module former, and of a length determined by the distance between said stop and said separator, lift slats carried by said module former and having a position in which they project inwardly of said side walls on each side of said support strip to extend under said products on said support strip, power means for raising said module former and lift slats to an upper limit position to raise the module of products, and a follower for supporting the leading product of the row upon retraction of said separator, moving in synchronism with said leading product along said support strip as said row of products advances into said module former under the action of said feeding conveyor, said follower moving through said stop to a point upstream of said stop to allow said leading product to come to rest against said stop.

14. A mechanism as defined in claim 13, wherein said support strip makes a downward bend in register with said separator to fan out the products and facilitate insertion of said blade between adjacent products.

15. A mechanism as defined in claim 13 or 14, wherein and lift slats are pivotally mounted on said module former for movement between said first-named projecting position and a retracted position in which said lift slats clear the space between said guiding side walls, and power means to pivot said lift slats between said two positions.

16. A mechanism as defined in claim 13 or 14, further including a stationarily-mounted back guide strip narrower than said products extending upwardly from and in substantial vertical alignment with said separator blade when the latter is in active separating position, said back guide strip extending centrally of the back of the trailing product of the module in the raised position of the module.

* * * * *